United States Patent [19]

Bartholomew et al.

[11] Patent Number: 4,693,406

[45] Date of Patent: Sep. 15, 1987

[54] RIVET TOOL HAVING REVERSIBLE ANVIL

[75] Inventors: Alan Bartholomew; Harold Bauer, both of Newton, Kans.; Loren E. Berry, Rothschild, Wis.; Glen Ediger, Newton, Kans.

[73] Assignee: Center Industries Corporation, Wichita, Kans.

[21] Appl. No.: 850,052

[22] Filed: Jun. 4, 1986

Related U.S. Application Data

[62] Division of Ser. No. 701,692, Feb. 14, 1987, Pat. No. 4,602,414.

[51] Int. Cl.[4] ..... B25C 11/00

[52] U.S. Cl. ..... 227/63; 72/412; 59/7; D8/51

[58] Field of Search ..... D8/51; 29/283, 256, 29/252, 243, 53, 243.54, 243.55; 72/412, 391, 472, 477, 479, 459; 59/7; 227/63

[56] References Cited

U.S. PATENT DOCUMENTS

| | | | |
|---|---|---|---|
| D. 191,414 | 9/1961 | Arnett et al. | D8/51 |
| D. 198,398 | 6/1964 | Smith | D8/51 |
| D. 203,877 | 2/1966 | Johnson et al. | D8/51 |
| D. 204,205 | 3/1960 | Rains | D8/51 |
| 936,580 | 10/1909 | Summers et al. | 227/63 X |
| 1,357,247 | 11/1920 | Myerson | 29/243.54 |
| 3,230,751 | 1/1960 | Smith | 72/412 X |
| 3,233,402 | 2/1966 | Urbaitis | 59/7 |
| 3,234,634 | 2/1966 | Johnson et al. | 59/7 |
| 3,412,597 | 11/1968 | Rains | 59/7 X |
| 4,476,615 | 10/1984 | Cook | 29/243.54 |

FOREIGN PATENT DOCUMENTS

| | | | |
|---|---|---|---|
| 2844867 | 4/1950 | Fed. Rep. of Germany | 72/477 |

*Primary Examiner*—Paul A. Bell

*Attorney, Agent, or Firm*—Schmidt, Johnson, Hovey & Williams

[57] ABSTRACT

An improved hand tool is provided which permits easy field removal and replacement of connecting rivets employed with agricultural implement sickle sections, and is especially designed for use with relatively new so-called double sickle sections which present only very limited working clearance. The tool preferably includes a pair of jaw sets respectively extending from each end of a handle. The handle is contoured to allow pivotal adjustment between various sickle section spacings. The jaw sets carry structure for either removing or replacing a rivet on a damaged sickle section without removing the sickle section mounting bar from the cutter bar. A removable anvil is included as a component of the rivet-replacing jaw set to permit replacement of different types of rivets through the simple expedient of reversing the anvil position.

1 Claim, 9 Drawing Figures

Fig. 1
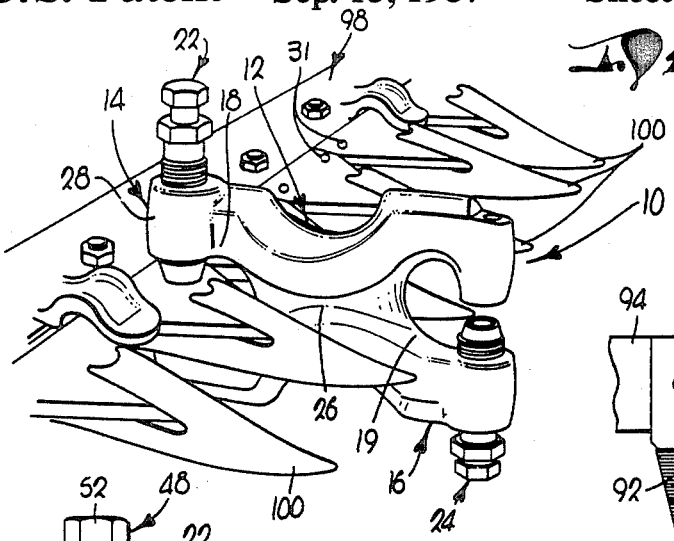
Fig. 9
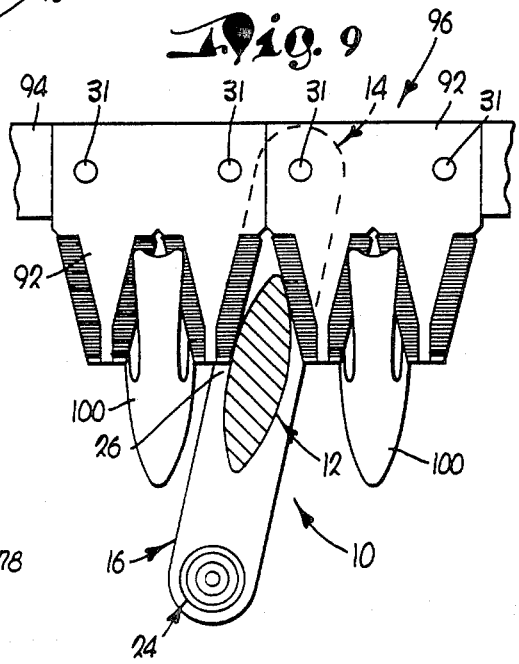
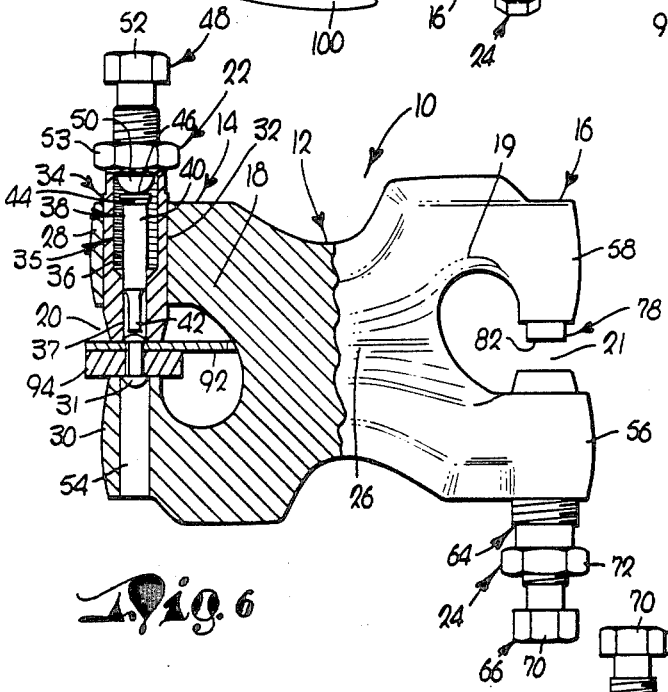
Fig. 6
Fig. 2
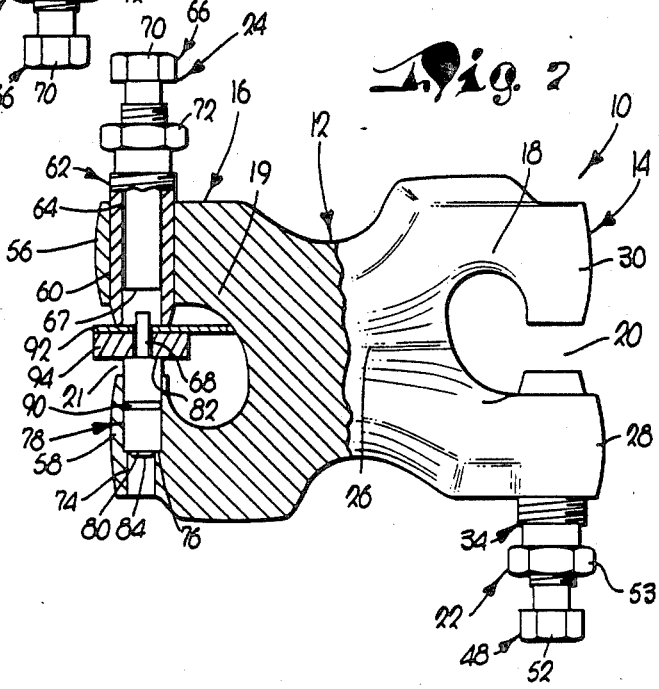
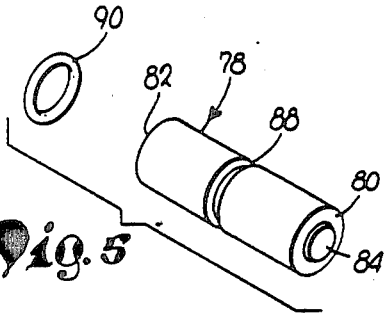
Fig. 5

Fig. 8
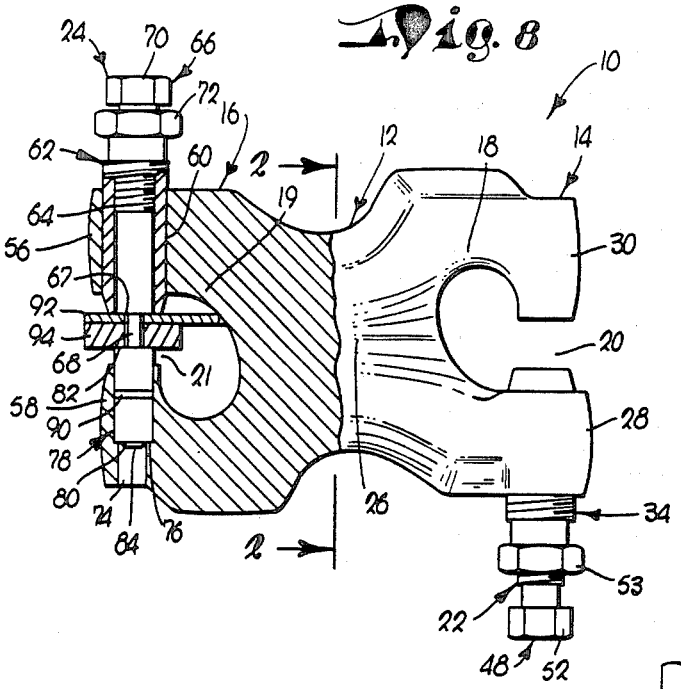
Fig. 4
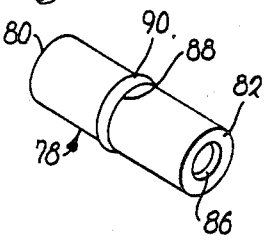
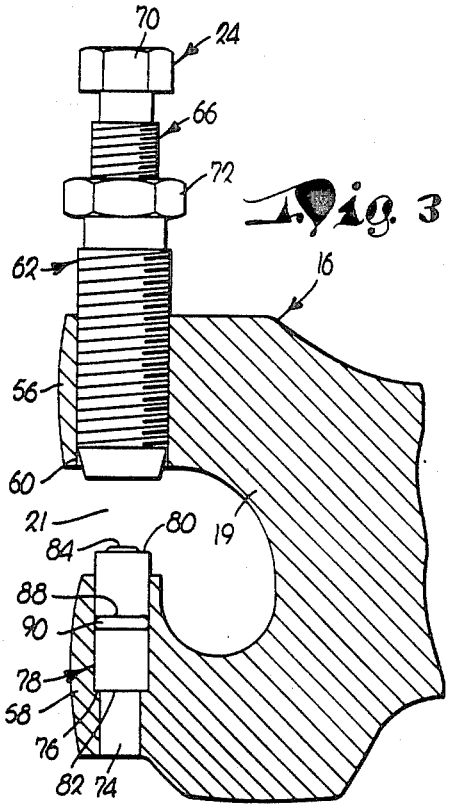
Fig. 3
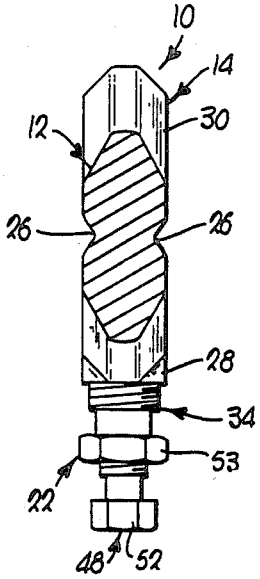
Fig. 2

RIVET TOOL HAVING REVERSIBLE ANVIL

This is a division of application Ser. No. 701,692 filed on Feb. 14, 1985, now U.S. Pat. No. 4,602,414.

BACKGROUND OF THE INVENTION

1. Field of the Invention

This invention relates to a hand tool for removal and replacement of sickle section rivets. The tool can be used in the repair of various types of sickle sections, especially the new so-called double sickle sections. More particularly, the tool of the invention has a specially designed handle permitting pivotal adjustment between a pair of double sickle sections to thus facilitate access to the connecting rivets, together with a removable, reversible anvil having end faces respectively configured for use with different types of rivet heads.

2. DESCRIPTION OF THE PRIOR ART

Hand tools for field removal and replacement of sickle section rivets have been proposed in the past. For example, U.S. Pat. Nos. 3,230,751 and 3,412,597 disclose a type of tool in widespread use. However, recently introduced sickle sections having a variety of rivet head styles have presented problems, inasmuch as the prior tools have difficulty accommodating the various rivet and sickle section designs.

A particular problem arises by virtue of use of the double sickle sections, in that only a limited amount of working space is provided between adjacent sickle sections. The configuration of the prior patented rivet tools is such that working access to the double sickle section connecting rivets is difficult if not impossible to achieve. As a consequence, the farmer must then disassemble the sickle section support from the cutter bar and manually replace the damaged double sickle section. In this procedure, the sickle section rivets are punched out and then replaced by the time-consuming operation of peening the rivet closed with a hammer.

Another problem results from the necessity of providing maximum clearance and minimum drag for the cutter bar as it travels close to the ground. Consequently, the manufacturer typically includes in the design of the implement a combination of rivet styles and rivet locations. This variability in rivet styles may require the use of different rivet tools to remove or replace each type of rivet head.

Accordingly, there is a decided need in the art for a single rivet tool which can be used on a variety of sickle section designs, and which can accommodate a variety of rivet head styles.

SUMMARY OF THE INVENTION

The problems outlined above are in large measure solved by the hand tool in accordance with the present invention. That is to say, the hand tool hereof is designed to facilitate repair or replacement of various sickle section designs, including the new double sickle sections, and includes structure for replacement of different types of rivet heads.

The hand tool in accordance with the present invention broadly includes an elongated handle having a pair of working jaw sets respectively extending from each end thereof, one jaw set being equipped with structure for removal of a sickle section rivet, while the other has structure for replacement of a sickle section rivet.

In particularly preferred forms, the elongated central handle contains a smoothly tapered, longitudinally extending groove on each side thereof permitting pivotal adjustment of the tool in the constricted region between a pair of double sickle sections so that working access to the rivets can be readily obtained. Additionally, the structure carried by the rivet-replacing jaw set includes a removable anvil bar having opposed end faces suitable for use on different types of rivet heads. The rivet tool can readily be used in the field to replace damaged sickle sections merely by inserting the reversible anvil bar into the rivet-replacing jaw set so that the exposed anvil end face corresponds to the specific rivet head being replaced.

BRIEF DESCRIPTION OF THE DRAWINGS

FIG. 1 is a perspective view of the tool of the invention in a working position on a multiple sickle section cutter bar;

FIG. 2 is a vertical sectional view taken along line 2—2 of FIG. 8 which illustrates the position of the marginal grooves on the hand tool body;

FIG. 3 is an enlarged, fragmentary view in vertical section of the rivet-replacing end of the tool showing the anvil in position for replacement of a countersunk flat head rivet;

FIG. 4 is a perspective view of the preferred rivet-replacing anvil and depicting an O-ring retainer secured thereto;

FIG. 5 is an exploded view of the anvil and O-ring retainer illustrating the reception groove for the O-ring retainer;

FIG. 6 is a side view in partial vertical section of the tool in an orientation for removing a rivet from a sickle section;

FIG. 7 is a side view in partial vertical section of the tool in a position reversed from that in FIG. 6 and in an orientation for replacement of a rivet with the headed end of the rivet positioned in the recess of the anvil;

FIG. 8 is a view similar to FIG. 7 but illustrating the position of the tool after the end of the rivet has been closed; and FIG. 9 is a fragmentary top view illustrating the tool in cross-section and in a working position between sickle sections, the portion of the tool beneath the cutter bar being depicted in phantom.

DESCRIPTION OF THE PREFERRED EMBODIMENT

Referring now to the drawing, a hand tool 10 in accordance the invention broadly includes a central handle 12 having a pair of jaw sets 14, 16 respectively extending from each end thereof. Jaw set 14 presents a generally C-shaped body 18 and an open sickle section receiving mouth 20, whereas jaw set 16 likewise presents a C-shaped body 19 and mouth 21. The mouths 20, 21 of the respective jaw sets 14, 16 are in general horizontal alignment with each other. Jaw set 14 carries structure 22 for removal of a rivet, while jaw set 16 carries structure 24 for replacement of a rivet. The structures 22, 24 for removal and replacement of rivets are in opposed and inverted relationship to each other for balancing the tool in a hand held position.

In more detail, the elongated handle 12 is a metallic body preferably including a smoothly tapered, elongated, axially extending groove 26 on each side thereof, the depth of the grooves 26 being greater adjacent mouths 20, 21 of each jaw set 14, 16.

Referring to FIG. 6, jaw set 14 includes a pair of opposed jaws 28, 30 that are configured for removal of a rivet 31. Jaw 28 includes a threaded vertically extending opening 32 therethrough. A clamping screw 34 is threaded into opening 32 for movement toward and away from mouth 20. Clamping screw 34 includes a continuous bore 35 therethrough, made up of an internally threaded central passage 36 and a restricted diameter lower bore portion 37. The overall bore 35 extends between opening 32 and mouth 20.

An elongated rivet-removing punch 38 is received in and guided by the bore 35 for a sliding movement toward and away from mouth 20. Punch 38 includes a main shank 40 and shaft end 42, the latter being of smaller cross-section than shank 40. Shank 40 has a flange end 44 and abutment face 46 remote from mouth 20.

A bolt 48 is threaded into passage 36 for movement toward and away from punch 38. Bolt 48 has a hemispherical end 50 that contacts abutment face 46 of punch 38 when the bolt is rotated towards the latter. When the bolt 48 is further rotated, it forces punch 38 to move toward and into mouth 20. Both bolt 48 and clamping screw 34 are provided with wrench-receiving heads 52 and 53 for ease of adjustment.

The opposed jaw 30 of jaw set 14 includes a rivet-receiving bore 54 therethrough in alignment with threaded opening 32.

Referring to FIGS. 7 and 8, jaw set 16 includes opposed jaws 56 and 58 that cooperate for replacement of a rivet. Jaw 56 includes an elongated threaded opening 60 therethrough. Clamping screw 62 is threaded into bore 60 for movement toward and away from mouth 21. Clamping screw 62 also includes an elongated, central threaded passage 64 therethrough. Bolt 66 is threaded into passage 64 for movement toward and away from mouth 21 and includes a lowermost recessed die end 67 (see FIG. 6, above mentioned U.S. Pat. No. 3,230,751) proximal to mouth 21 for cold closing by pressure of a rivet 68. Both the bolt 66 and clamping screw 62 include wrench-receiving heads 70 and 72.

The opposed jaw 58 of jaw set 16 includes an elongated, stepped bore 74 therethrough presenting an annular support flange 76 intermediate the ends thereof. An anvil bar 78 is removably inserted into bore 74. The anvil bar 78 includes an end face 80 having a platform 84 for receiving a countersunk flat head rivet, and an opposed end face 82 having a recess 86 for receiving a round head rivet. A circumferential groove 88 is located intermediate the ends of anvil bar 78. An O-ring 90 or any other suitable friction retaining device is seated in groove 88 for retaining anvil bar 78 in bore 74 during operation and storage.

Hand tool 10 is adapted for removal and replacement of a variety of rivets such as the rivets 31 and 68 depicted in the drawings. The function of rivets 31, 68 is to secure aligned sickle sections 92 to a mounting strip 94 of a conventional sickle assembly 96. In such an assembly, the mounting bar 94 is secured to a cutter bar 98, and a number of guards 100 are bolted to cutter bar 98. In operation, the sickles 92 are reciprocated for cutting a standing crop as the overall implement is advanced through a field.

In use, hand tool 10 is used to replace a damaged sickle sections such as section 92 secured by a pair of rivets 31 to bar 94. End 14 of tool 10 is first placed between a pair of adjacent sickle sections 92 (see FIG. 9) with the mouth 20 receiving section 92 and bar 94. The configuration of handle 12, and particularly the grooves 26, allows tool 10 to be pivotally adjusted until the rivet-removing structure 22 is properly aligned over rivet 31. Clamping screw 34 is then rotated toward the sickle section 92 until screw 34 engages the upper face of section 92. Rivet 31 is thus aligned with opening 32 and bore 54.

To remove rivet 31, a wrench (not shown) is placed on head 52, and bolt 48 is rotated to advance the same toward punch 38. Hemispherical end 50 of bolt 48 first contacts flat face 46 of punch 38 causing the punch to shift toward and into mouth 20. Further rotation of bolt 48 causes punch 38 to contact rivet 31, thereby forcing the latter downwardly and into bore 54. Clamping screw 34 is then backed off so that tool 10 can be removed from the cutter bar assembly. The adjacent rivet 31 of the damaged sickle section 92 is then removed in a similar fashion.

Tool 10 is first prepared to receive rivet 68 by retracting clamping screw 62 as far as possible into jaw 56, whereupon anvil bar 78 is inserted into threaded opening 60 and then lowered into bore 74. Anvil bar 78 is positioned so that either end face 80 or 82 is uppermost and adjacent mouth 21 depending upon the style of rivet to be replaced, either round headed or flat headed. As depicted in FIG. 7, a rivet 68 having a round head is employed, and as a consequence bar 78 is oriented with end face 82 adjacent mouth 21. Clamping screw 62 is rotated towards mouth 21 until it contacts anvil bar 78, and initially secures the latter in bore 74. Clamping screw 62 is then further rotated to gradually force anvil bar 78 into bore 74 until the bar 78 bottoms out against and is supported by flange 76. Tool 10 is now ready to replace rivet 68.

A new sickle section **92*a* is then secured to mounting strip 94. Rivet 68 is first inserted through a corresponding rivet hole in strip 94, whereupon sickle section 92*a*** is manually positioned over the rivet.

Tool 10 is next positioned between an existing sickle section 92 and then new section **92*a*, aided by groove 26, with jaw set 16 aligned over a rivet 68. Clamping screw 62 is then rotated downwardly into engagement with the upper face of sickle section 92*a* to be secured. The headed end of rivet 68 is then seated on the corresponding end face 82 of anvil bar 78, with the opposite end of rivet 68 positioned in threaded opening 60**.

Rivet 68 is cold closed by rotating bolt 66 toward rivet 68. Die end 67 of bolt 66 contacts and forms a head on the end of rivet 68, thus adequately securing section **92*a* to mounting bar 94**.

Clamping screw 62 is next backed off from rivet 68 permitting tool 10 to be removed from its working position. The adjacent rivet 68 of section **92*a*** is then replaced in a similar fashion.

The entire process of removing rivets 31 and replacing rivets 68 on sickle sections 92 may thus be completed with hand tool 10 without having to remove cutter bar 98 from the farm implement so that the farmer can quickly replace damaged sickle sections in the field.

We claim:

1. A hand tool for removal and replacement of double sickle section rivets, comprising:

a handle having fore and aft ends and presenting a pair of opposed side faces;

two working jaw sets respectively extending in generally opposite directions from said fore and aft ends of said handle, each of said jaws cooperatively presenting a generally C-shaped configuration and open, sickle section-receiving mouth, said mouths being in general horizontal alignment with each other;

means for permitting movement of said working jaw sets between a pair of adjacent, juxtaposed double-sickle sections for operable access to said sickle section rivets, said movement-permitting means comprising walls defining an elongated, fore and aft extending groove in said opposed side faces of said handle portion and in horizontal alignment with said mouths of said jaws;

one of said jaw sets having structure for replacement of a sickle section rivet, including structure defining a bore in one of said jaws;

an elongated anvil bar having opposed end faces and configured for removable insertion into said bore, said end faces respectively including structure for alternately receiving different types of sickle section rivet heads; and means carried by the other of said jaws for cooperatively engaging and closing the end of a sickle section rivet remote from said anvil;

the other of said jaw sets having structure for replacement of a sickle section rivet, including structure defining a bore in one of said jaws; and means carried by the other of said jaws for cooperatively engaging and pressing the rivet from the sickle and into said bore.

* * * * *